US010375494B1

(12) United States Patent
Chou

(10) Patent No.: US 10,375,494 B1
(45) Date of Patent: Aug. 6, 2019

(54) MICROPHONE TEST DEVICE

(71) Applicant: Primax Electronics Ltd, Taipei (TW)

(72) Inventor: Jun-Hsueh Chou, Taipei (TW)

(73) Assignee: PRIMAX ELECTRONICS LTD, Taipei (TW)

( * ) Notice: Subject to any disclaimer, the term of this patent is extended or adjusted under 35 U.S.C. 154(b) by 0 days.

(21) Appl. No.: 16/017,019

(22) Filed: Jun. 25, 2018

(30) Foreign Application Priority Data

Apr. 20, 2018 (TW) ..... 107113563 A

(51) Int. Cl.

| | |
|---|---|
| ***H04R 29/00*** | (2006.01) |
| ***H04R 1/22*** | (2006.01) |
| ***H04R 3/04*** | (2006.01) |
| ***H04R 1/00*** | (2006.01) |
| ***H04R 1/02*** | (2006.01) |

(52) U.S. Cl.
CPC ..... *H04R 29/004* (2013.01); *H04R 1/025* (2013.01); *H04R 1/222* (2013.01); *H04R 3/04* (2013.01)

(58) Field of Classification Search
CPC ..... H04R 29/00; H04R 1/025; H04R 1/222; H04R 3/04
USPC ..... 381/58; 73/1.46
See application file for complete search history.

(56) References Cited

U.S. PATENT DOCUMENTS

| | | | | |
|---|---|---|---|---|
| 2,394,613 A * | 2/1946 | Houlgate | H04R 29/00 367/13 |
| 2,530,383 A * | 11/1950 | Estes | H04R 29/00 381/58 |
| 2005/0259829 A1* | 11/2005 | Van den Heuvel | H04R 25/30 381/60 |
| 2008/0304674 A1* | 12/2008 | David Ho | H04R 25/30 381/60 |
| 2014/0328489 A1* | 11/2014 | Ziegler | H04R 29/004 381/58 |
| 2015/0117654 A1* | 4/2015 | John | H04R 29/004 381/59 |

FOREIGN PATENT DOCUMENTS

JP WO 2010026724 A1 * 3/2010 ..... H04R 29/004

* cited by examiner

*Primary Examiner* — David L Ton
(74) *Attorney, Agent, or Firm* — Kirton McConkie; Evan R. Witt

(57) ABSTRACT

A microphone test device is provided to test a sound-receiving function of an under-test microphone. The microphone test device includes a test platform, a standard speaker module, a fixing mechanism and a pedestal. A sleeve of the standard speaker module includes a cone-shaped channel. A test acoustic wave from the standard speaker is centralized by the cone-shaped channel. Consequently, the interference of the acoustic wave reflection phenomenon is effectively reduced.

18 Claims, 9 Drawing Sheets

MICROPHONE TEST DEVICE

FIELD OF THE INVENTION

The present invention relates to a test device, and more particularly to a microphone test device.

BACKGROUND OF THE INVENTION

With the advent of the Internet age, people can use electronic devices to communicate and interact with each other at any time and in any place through wireless networks. In addition, a microphone for making a call or receiving commands has gradually become one of the essential components of the electronic device such as a smart watch, a notebook computer, a tablet computer, a personal digital assistant, a smart phone or a game console.

Generally, a microphone comprises plural sound-receiving parts. After the microphone is produced, it is necessary to test the sound-receiving functions of the sound-receiving parts. Please refer to FIGS. 1A and 1B. FIG. 1A schematically illustrates the architecture of a conventional microphone test device. FIG. 1B schematically illustrates the appearance of the conventional microphone test device. As shown in FIG. 1A, the microphone test system 9 comprises a computing device 90 and an anechoic box B. A test program 91 is executed in the computing device 90. The computing device 90 comprises a sound card 92, a microphone pre-amplifier 93, a connection interface 94 and a power amplifier 95. The sound card 92 is electrically connected with the power amplifier 95. The test program 91 is executed to connect and control the sound card 92, the microphone pre-amplifier 93 and the connection interface 94. For example, the connection interface 94 is a digital connection interface or an analog connection interface. Moreover, three standard speakers 96, three standard microphones 97 and an under-test microphone 8 are disposed within the anechoic box B. The anechoic box B is capable of isolating the interference of the ambient noise. Consequently, the accuracy of testing the under-test microphone 8 can be increased. The standard speakers 96 are electrically connected with the power amplifier 95. The standard microphones 97 are electrically connected with the microphone pre-amplifier 93. The under-test microphone 8 is electrically connected with the connection interface 94. In case that the under-test microphone 8 is a digital microphone, the connection interface 94 is a digital connection interface. In case that the under-test microphone 8 is an analog microphone, the connection interface 94 is an analog connection interface.

Please refer to FIGS. 1A and 1B again. The under-test microphone 8 comprises a first sound-receiving part 81, a second sound-receiving part 82 and a third sound-receiving part 83. Each sound-receiving part is aligned with the corresponding standard speaker 96 and the corresponding standard microphone 97. During the process of testing the under-test microphone 8, the test program 91 controls the sound card 92 to drive the power amplifier 95. Consequently, each of the standard speakers 96 generates a test acoustic wave S. The test acoustic wave S is transferred to the first sound-receiving part 81, the second sound-receiving part 82 and the third sound-receiving part 83. At the same time, the scattered test acoustic wave S is received by the standard microphones 97, which are arranged beside the first sound-receiving part 81, the second sound-receiving part 82 and the third sound-receiving part 83. After the test acoustic wave S is received by the first sound-receiving part 81, the second sound-receiving part 82, the third sound-receiving part 83 and the standard microphones 97, the corresponding sound signals are transferred from the under-test microphone 8 to the test program 91 through the connection interface 94 and transferred from the standard microphones 97 to the test program 91 through the microphone pre-amplifier 93. Consequently, the sound signals are further tested and analyzed.

Please refer to FIG. 1C. FIG. 1C is a frequency response diagram illustrating the testing result of the conventional microphone test system. In FIG. 1C, the X axis denotes the frequency (unit: Hz) of the sound signal received by the first sound-receiving part 81, the second sound-receiving part 82 and the third sound-receiving part 83, and the Y axis denotes the intensity (unit: dB) of the sound signals received by the first sound-receiving part 81, the second sound-receiving part 82 and the third sound-receiving part 83. The positions of the first sound-receiving part 81, the second sound-receiving part 82 and the third sound-receiving part 83 of the under-test microphone 8 are different. Consequently, when the test acoustic wave S transferred to the first sound-receiving part 81, the second sound-receiving part 82 and the third sound-receiving part 83, different acoustic wave reflection phenomena are generated. The reflected sound signals may influence the first sound-receiving part 81, the second sound-receiving part 82 and the third sound-receiving part 83 on reception of the test acoustic wave S. Consequently, the frequency response curves of the first sound-receiving part 81, the second sound-receiving part 82 and the third sound-receiving part 83 in the low frequency band (e.g., 100 Hz~200 Hz) and in the high frequency band (e.g., over 2000 Hz) are not well consistent with each other. Under this circumstance, the microphone test system 9 cannot accurately test whether the sound-receiving function of the under-test microphone 8 in the low frequency band and in the high frequency band is normal or not.

Therefore, there is a need of providing a microphone test device capable of achieving more consistent frequency response curves in the low frequency band and in the high frequency band so as to increase the accuracy of testing the sound-receiving function of the under-test microphone in the low frequency band and in the high frequency band.

SUMMARY OF THE INVENTION

The present invention provides a microphone test device capable of achieving more consistent frequency response curves in the low frequency band and in the high frequency band. Consequently, the accuracy of testing the sound-receiving function of the under-test microphone in the low frequency band and in the high frequency band is enhanced.

In accordance with an aspect of the present invention, there is provided a microphone test device for testing an under-test microphone. The microphone test device includes a test platform, a standard speaker module, a fixing mechanism and a pedestal. The standard speaker module includes a standard speaker, a sleeve and a standard microphone. The standard speaker generates a test acoustic wave. The sleeve includes a first accommodation space and a cone-shaped channel. The standard speaker is accommodated within the first accommodation space. The cone-shaped channel has a first opening and a second opening. The first opening and the second opening are opposed to each other. The cone-shaped channel is in communication with the first accommodation space through the first opening. The standard microphone is arranged beside the second opening. The standard speaker module is fixed on the test platform through the fixing mechanism. The pedestal is disposed on the test platform. The under-test microphone is fixed on the pedestal. The second opening faces a sound-receiving part of the under-test microphone. The test acoustic wave is transferred to the sound-receiving part through the first opening, the cone-shaped channel and the second opening sequentially.

In an embodiment, the sleeve further includes a second accommodation space, and the standard microphone is accommodated within the second accommodation space, so that a sound-receiving terminal of the standard microphone is located at the second opening.

In an embodiment, an included angle between the sound-receiving terminal and a travelling direction of the test acoustic wave is 45 degrees.

In an embodiment, the sleeve further includes a covering plate, the second opening is located at a first end of the sleeve, and the covering plate is fixed on a second end of the sleeve, so that the first accommodation space is a closed status.

In an embodiment, the standard speaker has a sound-outputting hole, and the sound-outputting hole is arranged beside the first opening. The test acoustic wave is outputted from the sound-outputting hole.

In an embodiment, a diameter of the sound-outputting hole is equal to a diameter of the first opening.

In an embodiment, a diameter of the first opening is larger than a diameter of the second opening.

In an embodiment, the diameter of the first opening is in a range between 8 mm and 40 mm.

In an embodiment, the diameter of the second opening is in a range between 4 mm and 20 mm.

In an embodiment, a vertical distance between the first opening and the second opening is 20 mm.

In an embodiment, the fixing mechanism includes a fixing seat and an adjusting part, and the adjusting part is connected with the fixing seat. A rotating shaft is arranged between the fixing seat and the adjusting part. The adjusting part is rotatable relative to the fixing seat through the rotating shaft.

In an embodiment, the adjusting part includes a sliding slot, and a portion of the sleeve of the standard speaker module is locked into the sliding slot. The standard speaker module is movable along the sliding slot, so that a distance between second opening and the under-test microphone is adjustable.

In an embodiment, when the adjusting part is rotated through the rotating shaft, a travelling direction of the test acoustic wave from the standard speaker module is correspondingly adjusted.

In an embodiment, the pedestal includes a positioning recess, and the under-test microphone is accommodated and fixed in the positioning recess.

In an embodiment, a driving shaft is located at a bottom side of the pedestal, and the pedestal is rotated with the driving shaft.

In an embodiment, the test platform has a pivotal hole corresponding to the driving shaft, and the driving shaft is penetrated through the pivotal hole.

In an embodiment, the sound-receiving part of the under-test microphone includes a first sound-receiving part, a second sound-receiving part and a third sound-receiving part.

Preferably, as the pedestal is rotated with the driving shaft, the test acoustic wave is transferred to the first sound-receiving part, the second sound-receiving part or the third sound-receiving part.

The above objects and advantages of the present invention will become more readily apparent to those ordinarily skilled in the art after reviewing the following detailed description and accompanying drawings, in which:

DETAILED DESCRIPTION OF THE PREFERRED EMBODIMENT

The present invention will now be described more specifically with reference to the following embodiments. It is to be noted that the following descriptions of preferred embodiments of this invention are presented herein for purpose of illustration and description only. It is not intended to be exhaustive or to be limited to the precise form disclosed.

Figure 1A:
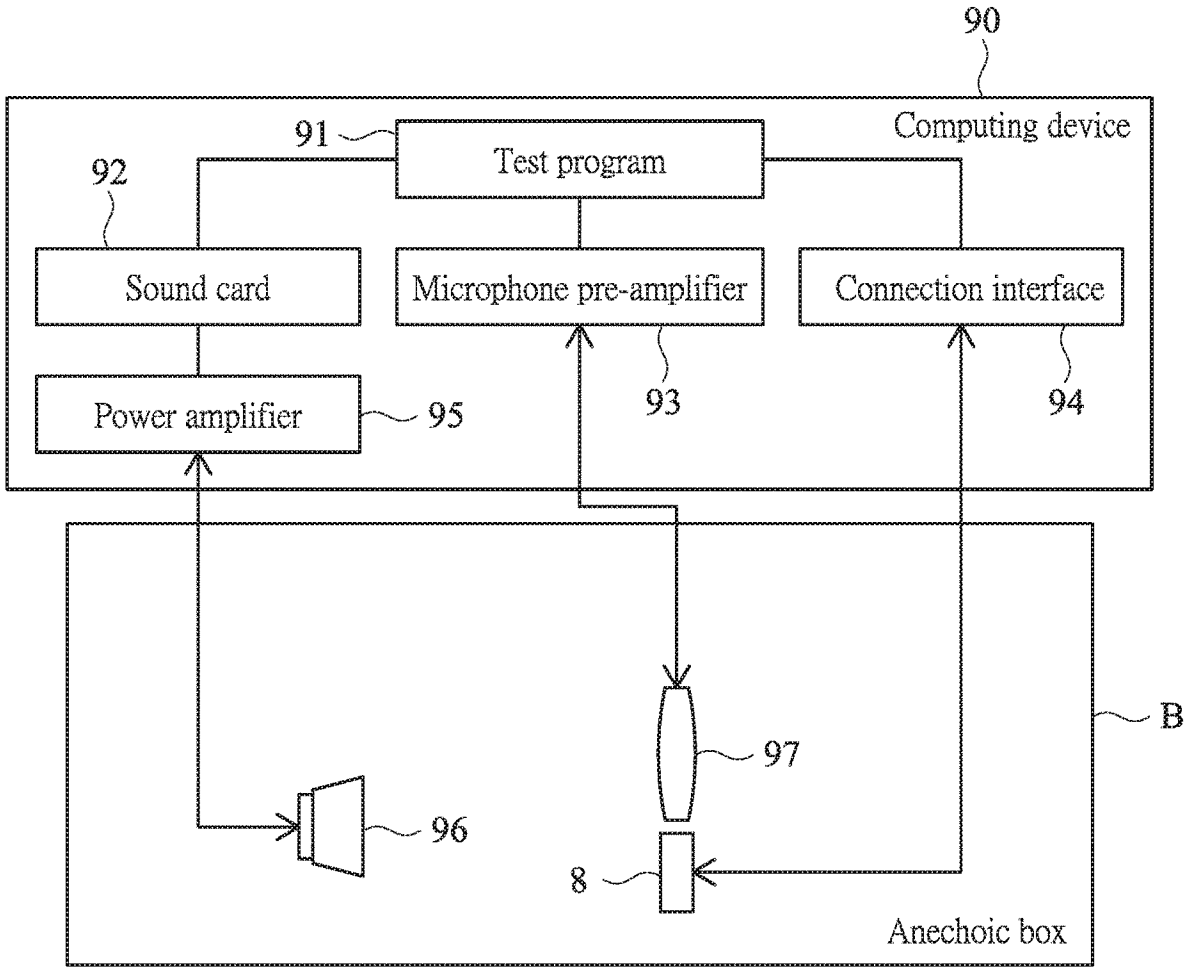
FIG. 1A (PRIOR ART)
FIG. 1A schematically illustrates the architecture of a conventional microphone test system.
Figure 1B:
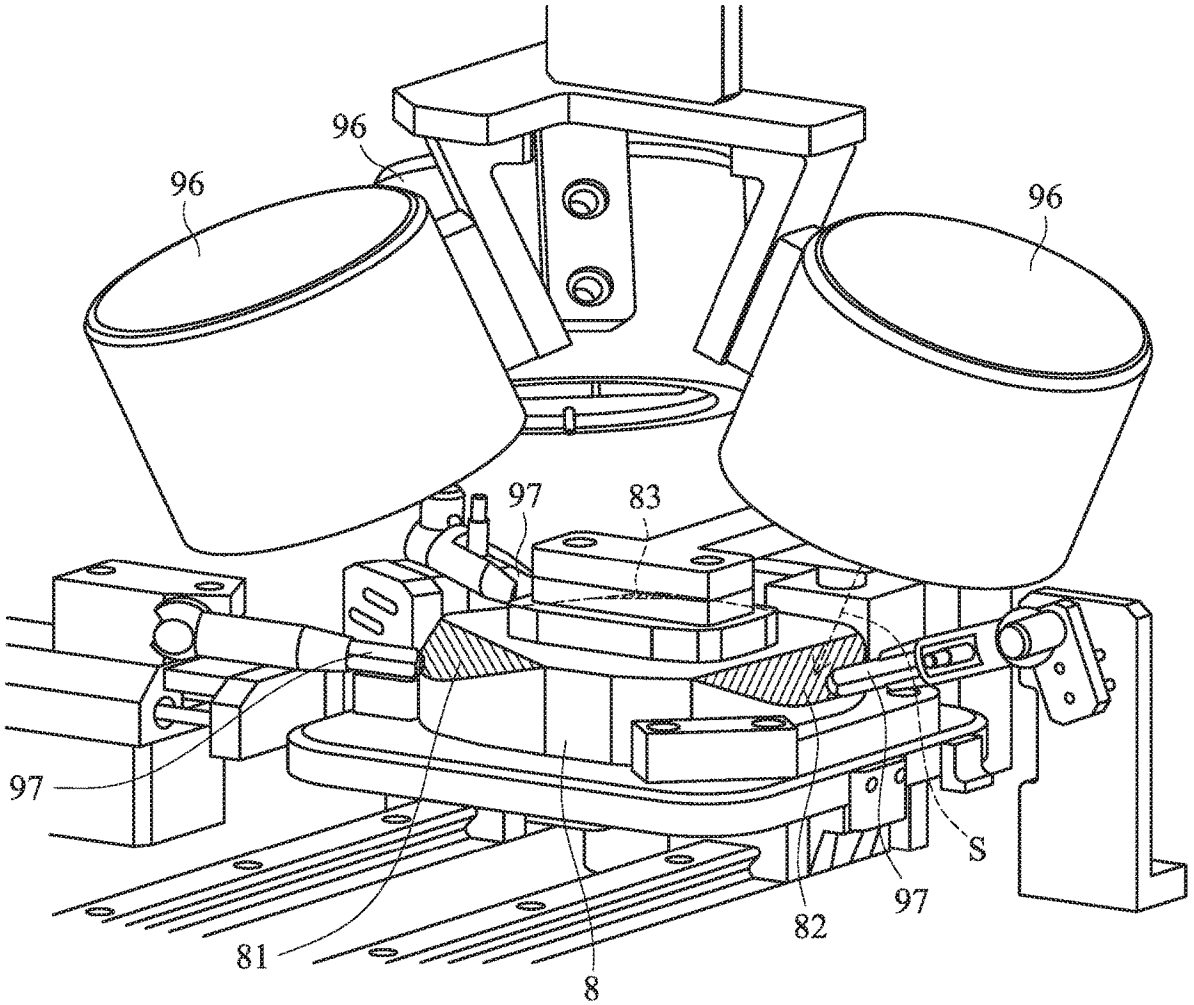
FIG. 1B (PRIOR ART)
FIG. 1B schematically illustrates the appearance of the conventional microphone test device.
Figure 1C:
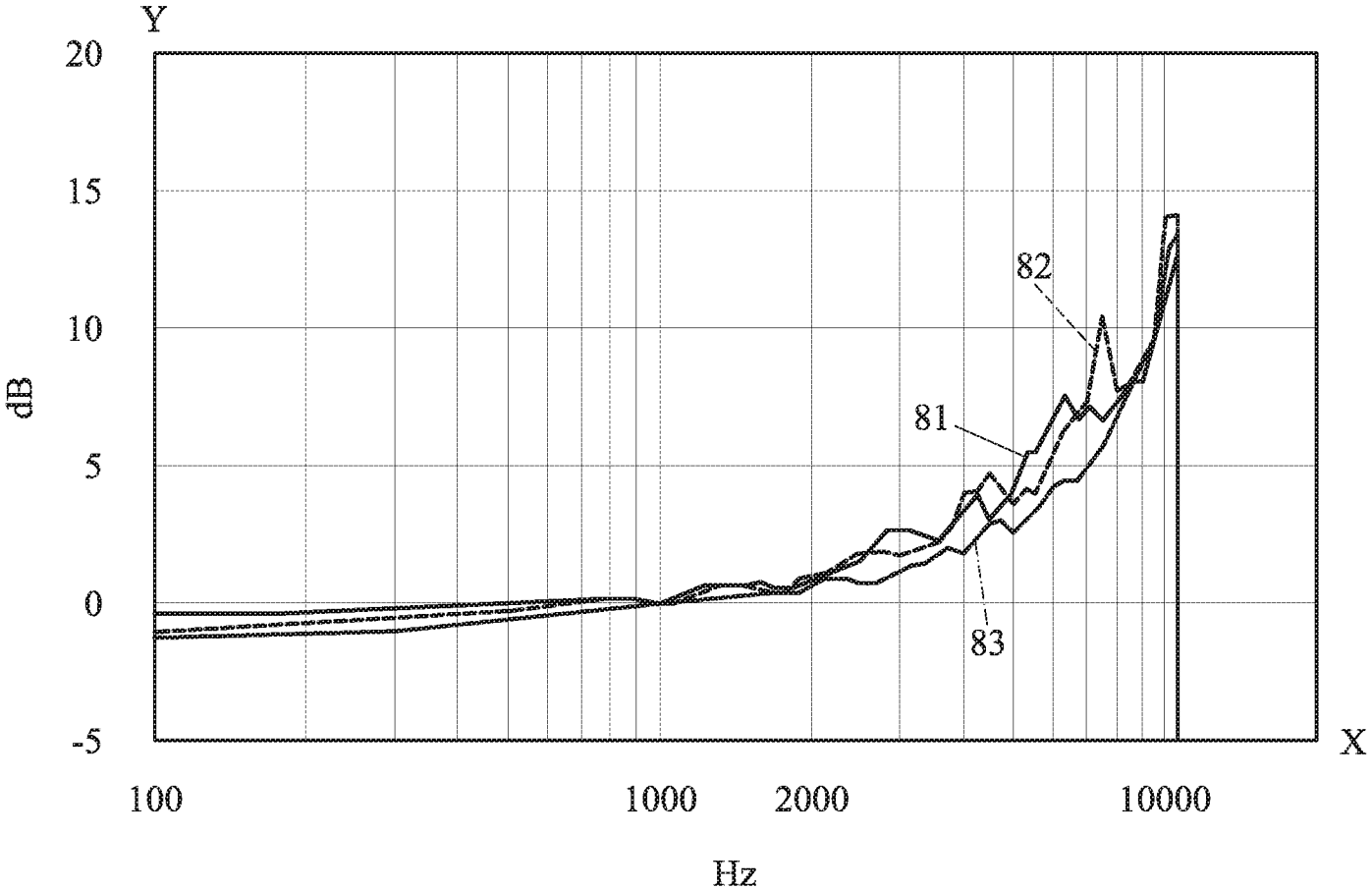
FIG. 1C (PRIOR ART)
FIG. 1C is a frequency response diagram illustrating the testing result of the conventional microphone test device.
Figure 2:
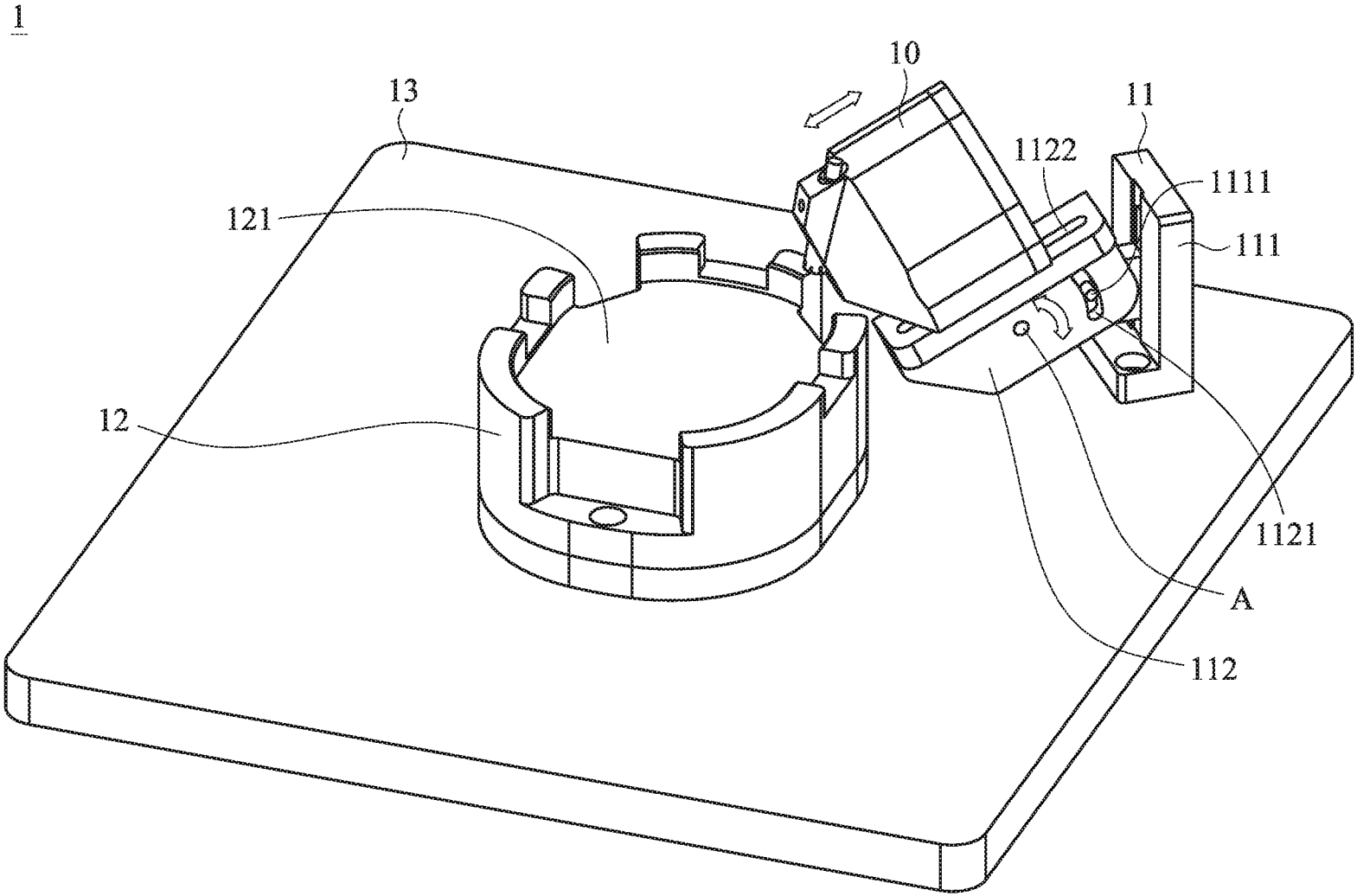
FIG. 2 is a schematic perspective view illustrating a microphone test device according to an embodiment of the present invention.

Please refer to FIG. 2. FIG. 2 is a schematic perspective view illustrating a microphone test device according to an embodiment of the present invention. As shown in FIG. 2, the microphone test device 1 comprises a standard speaker module 10, a fixing mechanism 11, a pedestal 12 and a test platform 13.

The pedestal 12 is disposed on the test platform 13. Moreover, the pedestal 12 comprises a positioning recess 121. The fixing mechanism 11 is used for fixing the standard speaker module 10 on the test platform 13. In an embodiment, the fixing mechanism 11 comprises a fixing seat 111 and an adjusting part 112. The adjusting part 112 is connected with the fixing seat 111. The fixing mechanism 11 is fixed on the test platform 13 through the fixing seat 111. A rotating shaft A is arranged between the adjusting part 112 and the fixing seat 111. The fixing seat 111 comprises a positioning rod 1111. The adjusting part 112 comprises a positioning hole 1121 corresponding to the positioning rod 1111. In addition, the positioning rod 1111 is penetrated through the positioning hole 1121. When the adjusting part 112 is rotated relative to the fixing seat 111 through the rotating shaft A, the positioning rod 1111 is movable within the positioning hole 1121. Due to the arrangement of the positioning rod 1111 and the positioning hole 1121, the rotating angle of the adjusting part 112 is restricted and the adjusting part 112 is limited at a specified angle. Consequently, the standard speaker module 10 faces a specified orientation. Moreover, the adjusting part 112 comprises a sliding slot 1122. A portion of the standard speaker module 10 is locked into the sliding slot 1122. Consequently, the standard speaker module 10 is movable along the sliding slot 1122. In the above embodiment, the standard speaker module 10 is fixed on the test platform 13 through the fixing mechanism 11. It is noted that numerous modifications and alterations may be made while retaining the teachings of the invention. In another embodiment, the standard speaker module 10 is fixed on a structure that is not connected with the test platform 13 through the fixing mechanism 11. For testing the under-test microphone, the standard speaker module 10 is moved to a position near the under-test microphone.

Figure 3A:
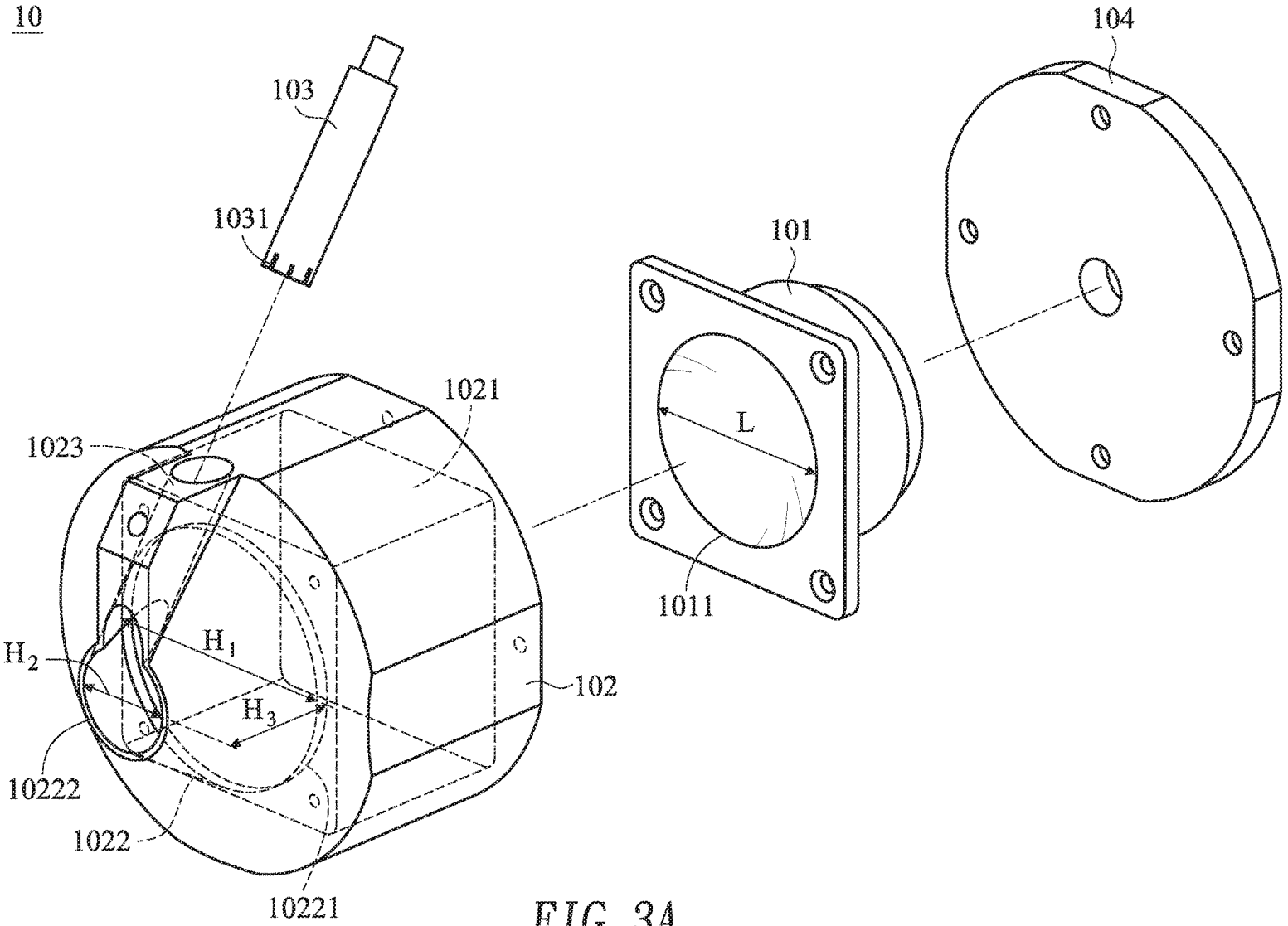
FIG. 3A is a schematic exploded view illustrating the standard speaker module of the microphone test device according to the embodiment of the present invention.
Figure 3B:
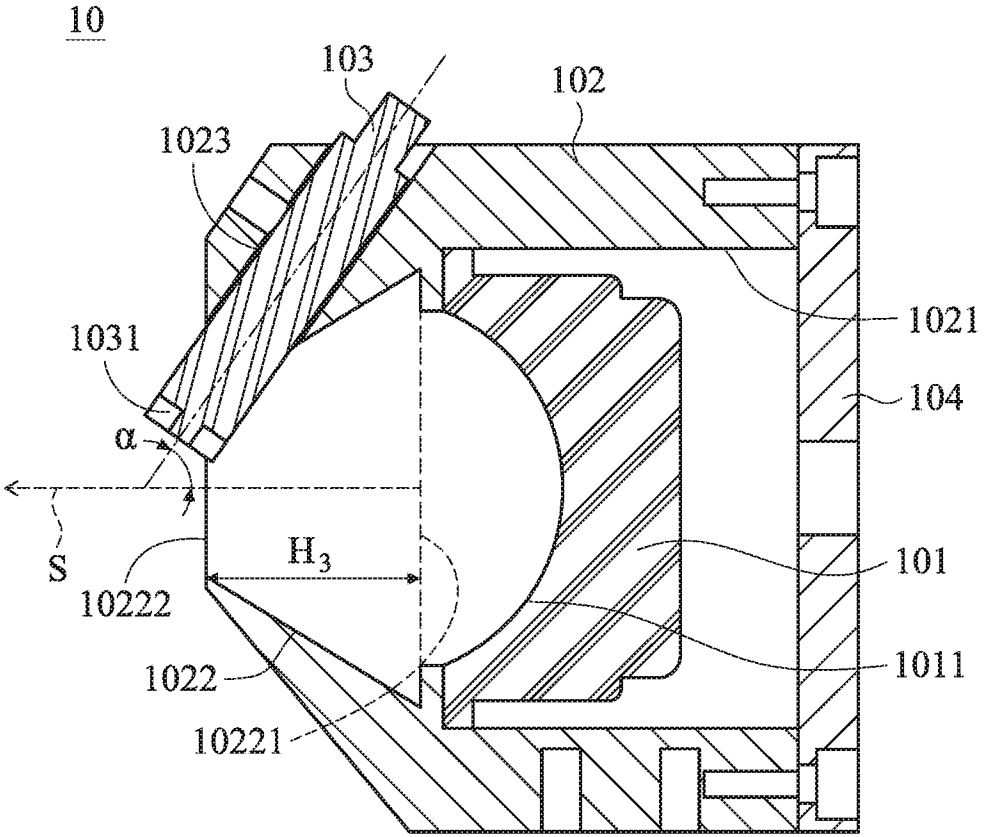
FIG. 3B is a schematic cross-sectional view illustrating the standard speaker module of the microphone test device according to the embodiment of the present invention.

Please refer to FIGS. 3A and 3B. FIG. 3A is a schematic exploded view illustrating the standard speaker module of the microphone test device according to the embodiment of the present invention. FIG. 3B is a schematic cross-sectional view illustrating the standard speaker module of the microphone test device according to the embodiment of the present invention.

As shown in FIG. 3A, the standard speaker module 10 comprises a standard speaker 101, a sleeve 102, a standard microphone 103 and a covering plate 104. The standard speaker 101 has a sound-outputting hole 1011. The diameter of the sound-outputting hole 1011 is L. The sleeve 102 comprises a first accommodation space 1021, a cone-shaped channel 1022 and a second accommodation space 1023. The cone-shaped channel 1022 has a first opening 10221 and a second opening 10222, which are opposed to each other. The cone-shaped channel 1022 is in communication with the first accommodation space 1021 through the first opening 10221. The diameter of the first opening 10221 is H1. The diameter of the second opening 10222 is H2. The vertical distance between the first opening 10221 and the second opening 10222 is H3. The standard microphone 103 has a sound-receiving terminal 1031. In an embodiment, the diameter L of the sound-outputting hole 1011 is equal to the diameter H1 of the first opening 10221. The diameter L of the sound-outputting hole 1011 is in the range between 8 mm and 40 mm. The diameter H1 of the first opening 10221 is in the range between 8 mm and 40 mm. The diameter H2 of the second opening 10222 is in the range between 4 mm and 20 mm. The vertical distance H3 between the first opening 10221 and the second opening 10222 is 20 mm.

Please refer to FIG. 3B. After the standard speaker 101 is accommodated within the first accommodation space 1021 of the sleeve 102, the sound-outputting hole 1011 of the standard speaker 101 is arranged beside the first opening 10221. The standard speaker 101 generates a test acoustic wave S. In addition, the test acoustic wave S is outputted from the sound-outputting hole 1011. After the test acoustic wave S is outputted from the sound-outputting hole 1011, the test acoustic wave S is transferred through the first opening 10221, the cone-shaped channel 1022 and the second opening 10222 sequentially. In this embodiment, the inner surface of the cone-shaped channel 1022 is tapered from the first opening 10221 to the second opening 10222. Consequently, while the test acoustic wave S is transferred through the cone-shaped channel 1022, the test acoustic wave S is centralized by the cone-shaped channel 1022. In such way, the test acoustic wave S is not over-scattered, and the test acoustic wave S is stably transferred along a travelling direction. The sleeve 102 has a first end and a second end. The second opening 10222 is located at the first end of the sleeve 102. The covering plate 104 is fixed on the second end of the sleeve 10 by a screwing means or an adhering means. Consequently, the first accommodation space 1021 is a closed status.

After the standard microphone 103 is accommodated within the second accommodation space 1023 of the sleeve 102, the standard microphone 103 is arranged beside the second opening 10222 and the sound-receiving terminal 1031 of the standard microphone 103 is located at the second opening 10222. Preferably but not exclusively, the included angle between the sound-receiving terminal 1031 of the standard microphone 103 and the travelling direction of the test acoustic wave S is 45 degrees. In the above embodiment, the standard microphone 103 is accommodated within the second accommodation space 1023, and thus the standard microphone 103 is arranged beside the second opening 10222. It is noted that numerous modifications and alterations may be made while retaining the teachings of the invention. For example, in another embodiment, the standard microphone 103 is arranged beside the second opening 10222 by a screwing means, a locking means or an adhering means.

Figure 4A:
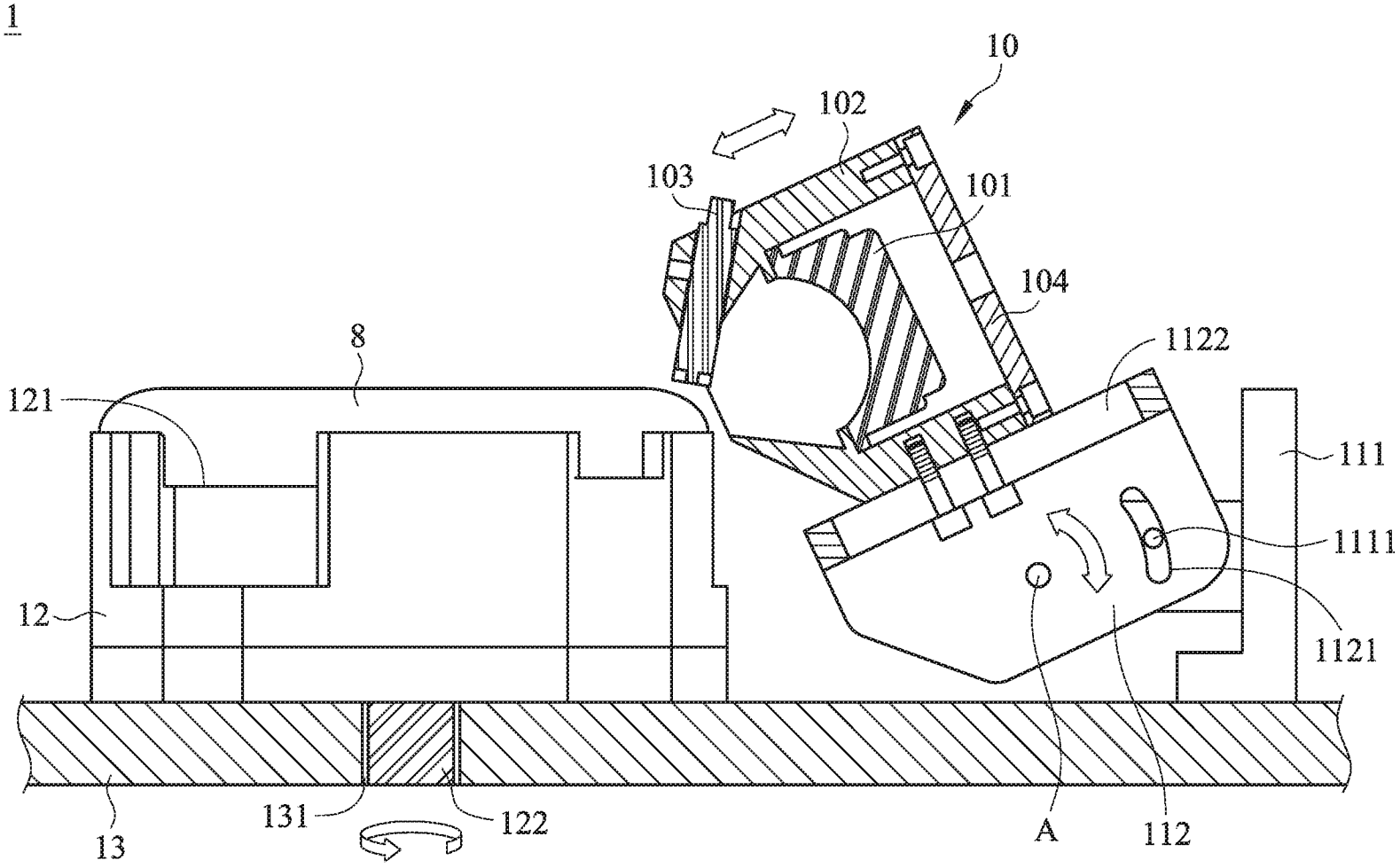
FIG. 4A is a schematic cross-sectional view illustrating the microphone test device according to the embodiment of the present invention.

FIG. 4A is a schematic cross-sectional view illustrating the microphone test device according to the embodiment of the present invention. As shown in FIG. 4A, an under-test microphone 8 is accommodated and fixed in the positioning recess 121 of the pedestal 12. A driving shaft 122 is located at a bottom side of the pedestal 12. The test platform 13 has a pivotal hole 131 corresponding to the driving shaft 122. Moreover, the driving shaft 122 is rotatable in a clockwise direction or a counterclockwise direction. As the pedestal 12 is rotated with the driving shaft 122, the orientation of the under-test microphone 8 on the pedestal 12 is correspondingly changed. In another embodiment, the pedestal 12 is rotated when an external force is applied to a lateral wall of the pedestal 12. In other words, the way of changing the orientation of the under-test microphone 8 is not restricted.

Please refer to FIG. 4A again. In this embodiment, a portion of the sleeve 102 of the standard speaker module 10 is locked and tightened into the sliding slot 1122. By adjusting the tightness of the screw element, the position of the standard speaker module 10 is changeable. As the standard speaker module 10 is moved along the sliding slot 1122, the distance between the second opening 10222 of the standard speaker module 10 (see FIG. 3B) and the under-test microphone 8 is adjusted. When the adjusting part 112 is rotated through the rotating shaft A, the travelling direction of the test acoustic wave S from the standard speaker module 10 (see FIG. 3B) is correspondingly adjusted.

Figure 4B:
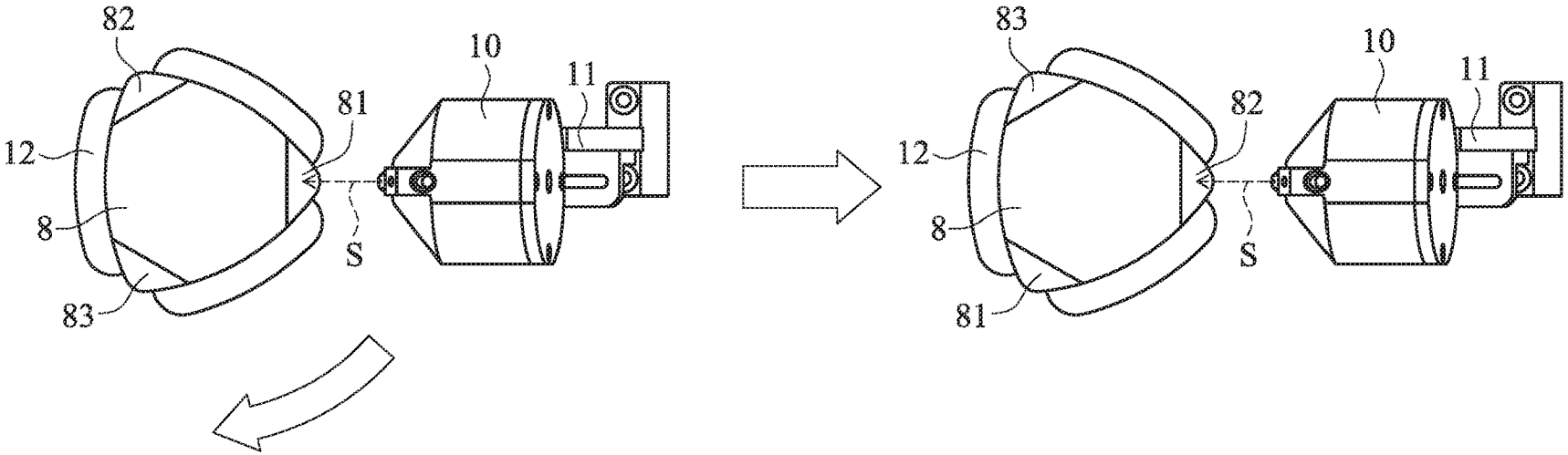
FIG. 4B schematically illustrates the operations of the microphone test device according to the embodiment of the present invention.

Please refer to FIG. 4B. FIG. 4B schematically illustrates the operations of the microphone test device according to the embodiment of the present invention. Firstly, the adjusting part 112 (see FIG. 4A) is rotated to have the second opening 10222 of the standard speaker module 10 (see FIG. 3B) face the first sound-receiving part 81 of the under-test microphone 8. Consequently, the test acoustic wave S is transferred to the first sound-receiving part 81. Moreover, by properly rotating the adjusting part 112, the travelling direction of the test acoustic wave S is perpendicular to the surface of the first sound-receiving part 81. Consequently, the influence of the acoustic wave reflection phenomenon on the result of testing the under-test microphone 8 will be effectively reduced. Moreover, the distance between the second opening 10222 of the standard speaker module 10 (see FIG. 3B) and the under-test microphone 8 may be adjusted through the sliding slot 1122. For example, the distance between the second opening 10222 and the under-test microphone 8 is in the range between 1 mm and 5 mm.

Please refer to FIG. 4B again. After the step of testing the first sound-receiving part 81 of the under-test microphone 8, the driving shaft 122 is rotated in the clockwise direction (see FIG. 4A) and the pedestal 12 is correspondingly rotated. Consequently, the standard speaker module 10 faces the second sound-receiving part 82 of the under-test microphone 8. Then, the test acoustic wave S is transferred from the standard speaker module 10 to the second sound-receiving part 82. Consequently, the second sound-receiving part 82 of the under-test microphone 8 is tested. Afterwards, the above steps are repeatedly done to test the third sound-receiving part 83 of the under-test microphone 8.

Figure 4C:
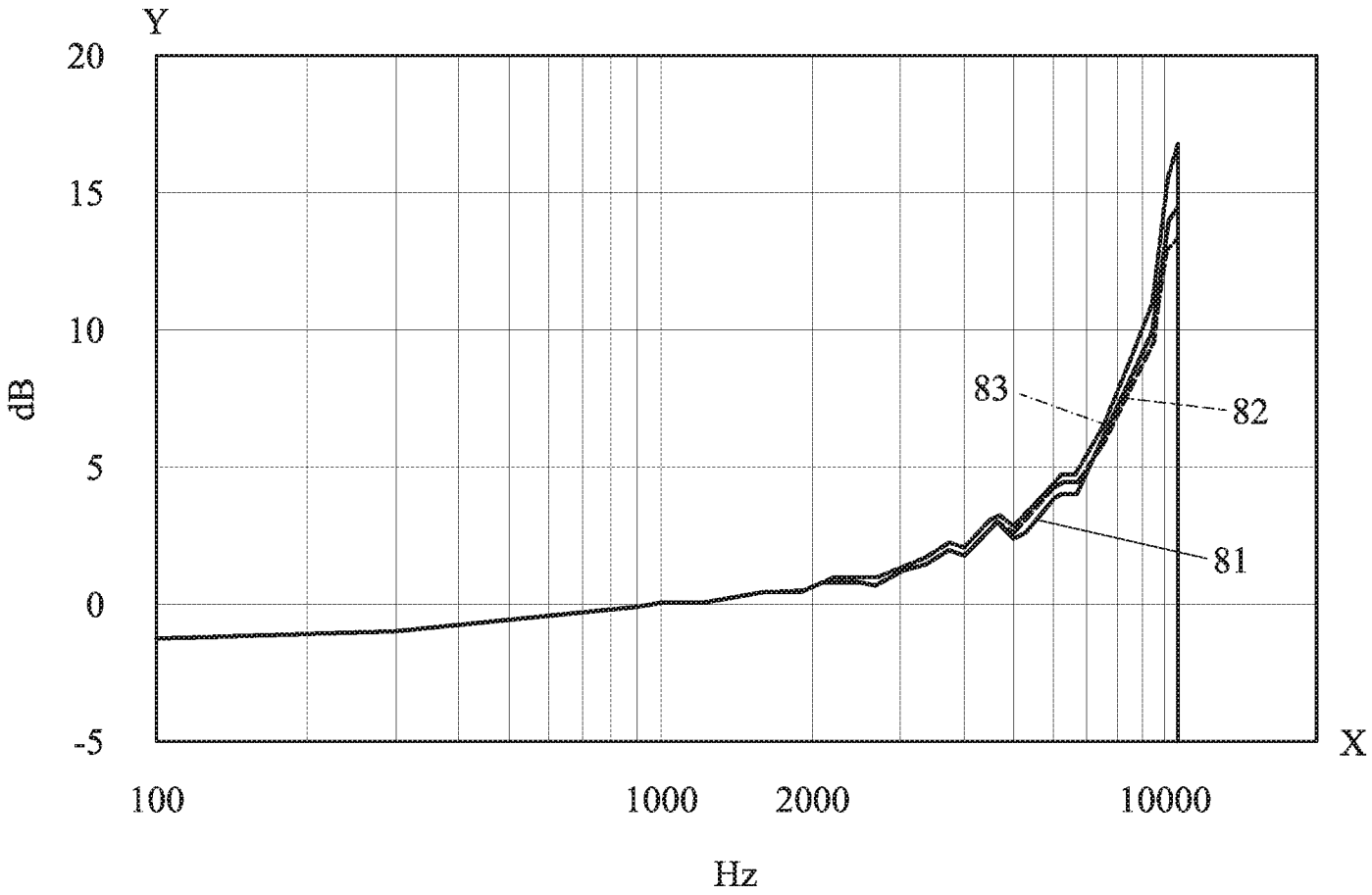
FIG. 4C is a frequency response diagram illustrating the testing result of the microphone test device according to the embodiment of the present invention.

Please refer to FIG. 4C. FIG. 4C is a frequency response diagram illustrating the testing result of the microphone test device according to the embodiment of the present invention. As mentioned above, the test acoustic wave S from the standard speaker 101 is centralized by the cone-shaped channel 1022 of the sleeve 102. In such way, the test acoustic wave S is not over-scattered, and the test acoustic wave S is stably transferred along the travelling direction. Moreover, the travelling direction of the test acoustic wave S is perpendicular to the surface of the sound-receiving part (e.g., the first sound-receiving part 81, the second sound-receiving part 82 or the third sound-receiving part 83). Consequently, when the test acoustic wave S is transferred to the sound-receiving part, the influence of the acoustic wave reflection phenomenon on the result of testing the under-test microphone 8 is effectively reduced. Since the frequency response of testing the under-test microphone 8 is improved, more consistent frequency response curves in the low frequency band and in the high frequency band are achieved. As shown in FIG. 4C, the frequency response curves of the first sound-receiving part 81, the second sound-receiving part 82 and the third sound-receiving part 83 in the low frequency band (e.g., 100 Hz~200 Hz) and in the high frequency band (e.g., over 2000 Hz) are well consistent with each other.

From the above descriptions, the present invention provides the microphone test system. The standard speaker module is specially designed. Consequently, when the test acoustic wave is transferred to the sound-receiving part of the under-test microphone, the interference caused by the acoustic wave reflection phenomenon is effectively reduced. Since the frequency response of testing the under-test microphone is improved, more consistent frequency response curves in the low frequency band and in the high frequency band are achieved. Moreover, according to the present invention, it is not necessary to install plural standard microphone beside the corresponding sound-receiving parts. Since the sound-receiving functions for all of the sound-receiving parts of the under-test microphone are tested under the same operating condition, the accuracy of testing the sound-receiving functions of the under-test microphone is effectively enhanced. In other words, the microphone test device of the present invention is industrially valuable.

While the invention has been described in terms of what is presently considered to be the most practical and preferred embodiments, it is to be understood that the invention needs not be limited to the disclosed embodiments. On the contrary, it is intended to cover various modifications and similar arrangements included within the spirit and scope of the appended claims which are to be accorded with the broadest interpretation so as to encompass all modifications and similar structures.

What is claimed is:

1. A microphone test device for testing an under-test microphone, the microphone test device comprising:

a test platform;

a standard speaker module comprising:

a standard speaker generating a test acoustic wave;

a sleeve comprising a first accommodation space and a cone-shaped channel, wherein the standard speaker is accommodated within the first accommodation space, and the cone-shaped channel has a first opening and a second opening, wherein the first opening and the second opening are opposed to each other, and the cone-shaped channel is in communication with the first accommodation space through the first opening; and a standard microphone arranged beside the second opening;

a fixing mechanism, wherein the standard speaker module is fixed on the test platform through the fixing mechanism; and a pedestal disposed on the test platform, wherein the under-test microphone is fixed on the pedestal, wherein the second opening faces a sound-receiving part of the under-test microphone, and the test acoustic wave is transferred to the sound-receiving part through the first opening, the cone-shaped channel and the second opening sequentially.

2. The microphone test device according to claim 1, wherein the sleeve further comprises a second accommodation space, and the standard microphone is accommodated within the second accommodation space, so that a sound-receiving terminal of the standard microphone is located at the second opening.

3. The microphone test device according to claim 2, wherein an included angle between the sound-receiving terminal and a travelling direction of the test acoustic wave is 45 degrees.

4. The microphone test device according to claim 1, wherein the sleeve further comprises a covering plate, the second opening is located at a first end of the sleeve, and the covering plate is fixed on a second end of the sleeve, so that the first accommodation space is a closed status.

5. The microphone test device according to claim 1, wherein the standard microphone has a sound-outputting hole, and the sound-outputting hole is arranged beside the first opening, wherein the test acoustic wave is outputted from the sound-outputting hole.

6. The microphone test device according to claim 5, wherein a diameter of the sound-outputting hole is equal to a diameter of the first opening.

7. The microphone test device according to claim 1, wherein a diameter of the first opening is larger than a diameter of the second opening.

8. The microphone test device according to claim 7, wherein the diameter of the first opening is in a range between 8 mm and 40 mm.

9. The microphone test device according to claim 7, wherein the diameter of the second opening is in a range between 4 mm and 20 mm.

10. The microphone test device according to claim 1, wherein a vertical distance between the first opening and the second opening is 20 mm.

11. The microphone test device according to claim 1, wherein the fixing mechanism comprises a fixing seat and an adjusting part, and the adjusting part is connected with the fixing seat, wherein a rotating shaft is arranged between the fixing seat and the adjusting part, and the adjusting part is rotatable relative to the fixing seat through the rotating shaft.

12. The microphone test device according to claim 11, wherein the adjusting part comprises a sliding slot, and a portion of the sleeve of the standard speaker module is locked into the sliding slot, wherein the standard speaker module is movable along the sliding slot, so that a distance between second opening and the under-test microphone is adjustable.

13. The microphone test device according to claim 12, wherein when the adjusting part is rotated through the rotating shaft, a travelling direction of the test acoustic wave from the standard speaker module is correspondingly adjusted.

14. The microphone test device according to claim 1, wherein the pedestal comprises a positioning recess, and the under-test microphone is accommodated and fixed in the positioning recess.

15. The microphone test device according to claim 1, wherein a driving shaft is located at a bottom side of the pedestal, and the pedestal is rotated with the driving shaft.

16. The microphone test device according to claim 15, wherein the test platform has a pivotal hole corresponding to the driving shaft, and the driving shaft is penetrated through the pivotal hole.

17. The microphone test device according to claim 15, wherein the sound-receiving part of the under-test microphone includes a first sound-receiving part, a second sound-receiving part and a third sound-receiving part.

18. The microphone test device according to claim 17, wherein as the pedestal is rotated with the driving shaft, the test acoustic wave is transferred to the first sound-receiving part, the second sound-receiving part or the third sound-receiving part.

* * * * *